United States Patent [19]

Lenhoff, Jr.

[11] 4,042,831

[45] Aug. 16, 1977

[54] CORE MEMORY PHASER DRIVER

[75] Inventor: John G. Lenhoff, Jr., Linthicum, Md.

[73] Assignee: Westinghouse Electric Corporation, Pittsburgh, Pa.

[21] Appl. No.: 650,992

[22] Filed: Jan. 21, 1976

[51] Int. Cl.[2] ..... H01P 1/32

[52] U.S. Cl. ..... 307/88 R; 333/24.1

[58] Field of Search ..... 307/88, 270, 314; 333/24.1; 343/854; 328/155

[56] References Cited

U.S. PATENT DOCUMENTS

| | | | |
|---|---|---|---|
| 3,835,397 | 8/1974 | D'Antonio | 328/155 |
| 3,988,686 | 10/1976 | Beall | 333/24.1 |

*Primary Examiner*—James W. Moffitt

*Attorney, Agent, or Firm*—R. M. Trepp

[57] ABSTRACT

A ferrite phaser driver circuit for phased array antennas wherein the input data is stored and subsequently fed to a ferrite phaser which has been immediately reset through a one-shot circuit configuration having means for compensating for power supply variations such that if the voltage drops, for example, the set period is lengthened automatically for a predetermined data input period. Additionally, the input data is adapted to be compressed in time when storing the data which becomes desirable when the input data is multiplexed where, for example, the arry is in the form of a matrix and the data input is applied for storage in rows and transferred to the respective phasers in columns.

14 Claims, 10 Drawing Figures

FIG. 1
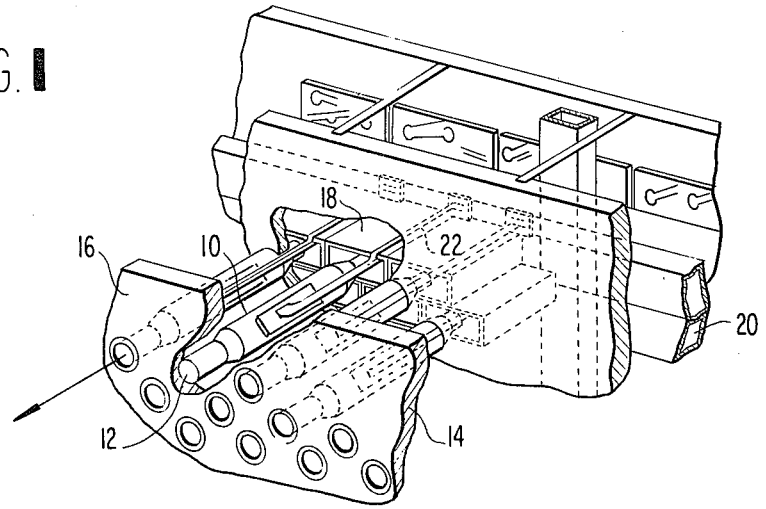
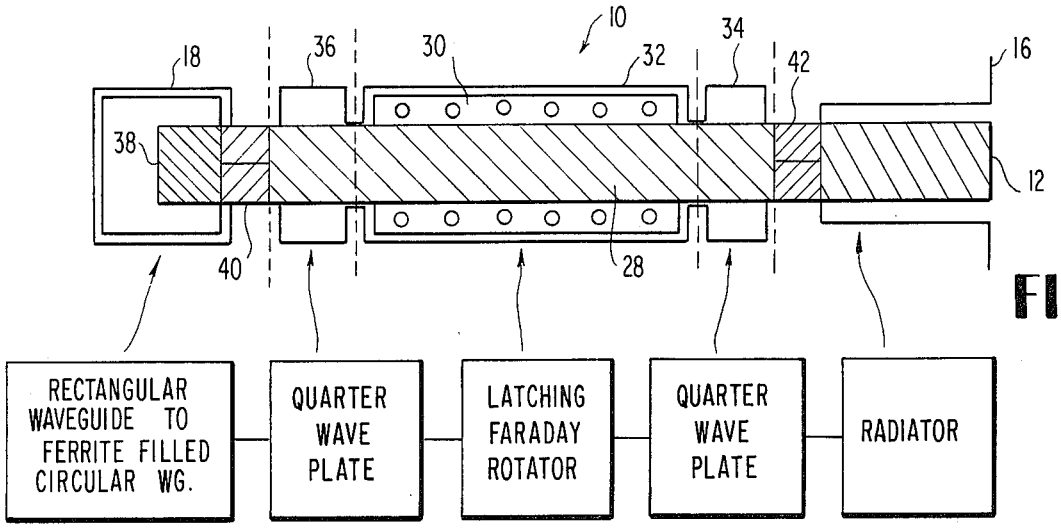
FIG. 2
FIG. 8
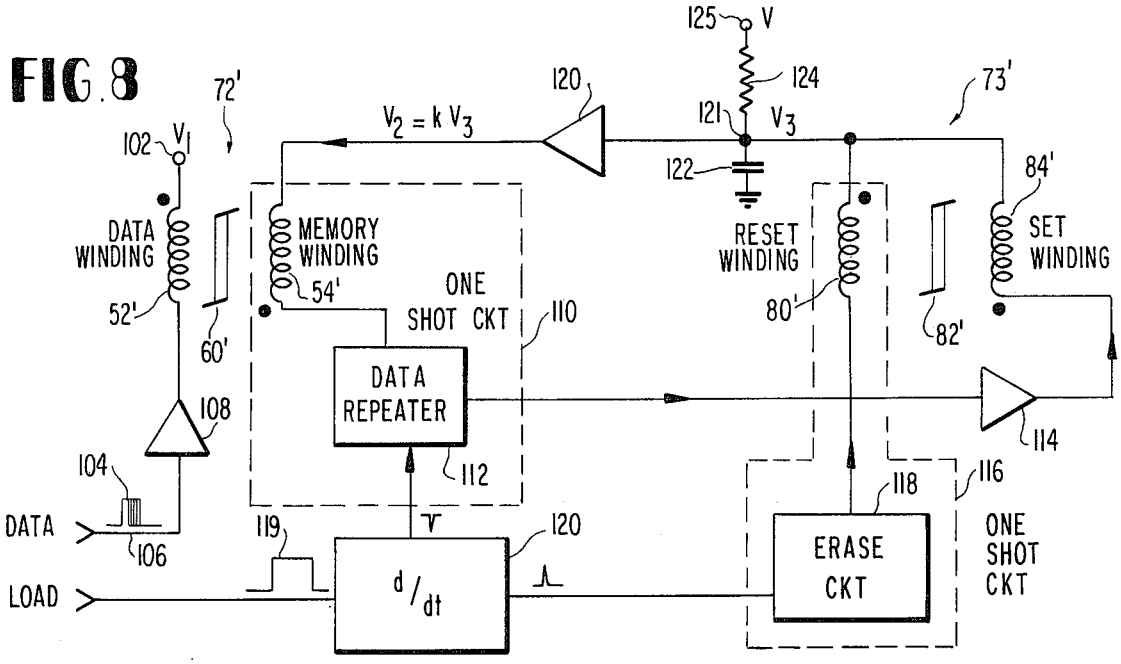

CORE MEMORY PHASER DRIVER

BACKGROUND OF THE INVENTION

1. Field of the Invention

This invention relates generally to beam steering apparatus for a phased array antenna and more particularly to a flux driver circuit for supplying control pulses to respective magnetically controlled microwave phase shifters employed therein.

2. Description of the Prior Art

In electronically steered phased array antennas, a plurality of individual antenna radiating elements are normally arranged in a linear or matrix array to provide beam steering by electronic techniques. Beam steering is accomplished by altering the phase relation of signals on different radiating elements. This is done by changing the corresponding phase of the phase shift device in the phased array element. The phase shift devices normally include a ferrite rod located within a waveguide section which in turn is surrounded by magnetizing and demagnetizing coils. Pulses of proper durations are selectively applied to the coils so that the magnetic material in the phase shifter is first driven into saturation in one direction by a reset pulse, and then driven in the opposite direction with a variable pulse-width set pulse. The width of the set pulse is determined by the predetermined flux level to be established in the phase shifter.

In any phase array antenna system containing a matrix of phasers, it becomes desirable to multiplex the data applied to the phase shifters. A number of drivers time share a common data line, receiving data during the time the system is transmitting and receiving. The drivers accordingly store the phase data until it is needed for the ferrite phasers. After all the drivers have received their respective data, a load command triggers the drivers causing them to proceed through a switching sequence, of first resetting the flux to a reference remnant state and then setting the flux to a desired remnant state to provide the desired phase shift.

Each data signal is usually stored in a capacitor type device with a voltage proportional to the desired phase shift. This capacitor can either be a sample and hold circuit receiving a voltage amplitude or it can be part of an integrating circuit integrating at pulse length. After a selected storage time, a set pulse is produced with a length proportional to the capacitor voltage, or if flux feedback is used, the capacitor voltage is compared to the flux integral to terminate the pulse.

As the quantity of ferrite phasers is increased to achieve better radar performance, the antenna array becomes a densely packed piece of apparatus. Consequently, the size and power that may be alotted to each driver decreases requiring that the driver circuitry must be miniaturized, such as by monolithic techniques.

When attempting to miniaturize these driver circuits, several problems emerge; the capacitors used fail to have the necessary capacity, the leakage resistance in the circuits is too low, the circuit requires standby power and the resulting monolithic chip becomes extremely complex.

SUMMARY

Briefly, the subject invention is directed to a flux driver circuit having a magnetic memory core adapted to store analog phase angle data and having a data winding and a memory winding wound thereon. Additionally a ferrite phaser core is included on which two coils are wound, a set winding and a reset winding connected in opposing polarities. The memory winding is coupled to the set winding by means of a one-shot circuit which is triggered on the trailing edge of a load pulse whose leading edge is used to trigger a second one-shot circuit coupled to the reset winding. The reset winding drives the ferrite phaser core to a reference remnant state prior to the set winding receiving a set pulse signal from the memory winding which is proportional to the data pulse applied to the data winding. The voltage feeding the memory winding, moreover, is proportionately related to the voltage feeding the set and reset windings by means of a signal path coupling the windings which relates the flux in the memory coil with the flux in the phaser coil, making the driver circuit insensitive to power supply variations.

DESCRIPTION OF THE DRAWINGS

FIG. 1 is a fragmented perspective view partially in section of a forward looking phased array antenna system;

FIG. 2 is a longitudinal cross sectional view generally illustrative of typical latching ferrite phaser;

FIG. 8 is a block diagram broadly illustrative of the subject invention;

DESCRIPTION OF THE PREFERRED EMBODIMENT

Figure 3:
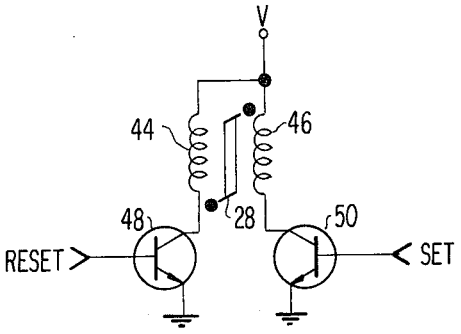
FIG. 3 is an electrical schematic diagram illustrative of the switching windings associated with a ferrite phaser.

Referring now to the figures and more particularly to FIG. 1, reference numeral 10 generally designates a latching ferrite phaser included in a matrix array having a radiating element 12 projecting through an aperture of an antenna structural member 14 having a thin metal ground plane 16. Each phaser element 10 is fed from respective rectangular waveguide members 18 fed from a waveguide manifold 20. Each phaser 10 has a driver circuit mounted to it with control and power wires 22 leading thereto.

Referring now to FIG. 2, there is disclosed the details of a typical latching ferrite phaser. It consists of, for example, a latching Faraday rotator section including a ferrite core 28 surrounded by switching coil assembly 30 and an external yoke 32. Circular polarizers comprised of quarter wave plates 34 and 36 are located on either side of the Faraday rotator section 28. A matching transformer element 38 and a polarization selector 40 couple microwave energy from the waveguide member 18 to the rotator through the quarter wave plate 36. The other end of the polarizer couples to the radiating element 12 by means of a second polarization selector 42 and the quarter wave plate 34.

Figure 4:
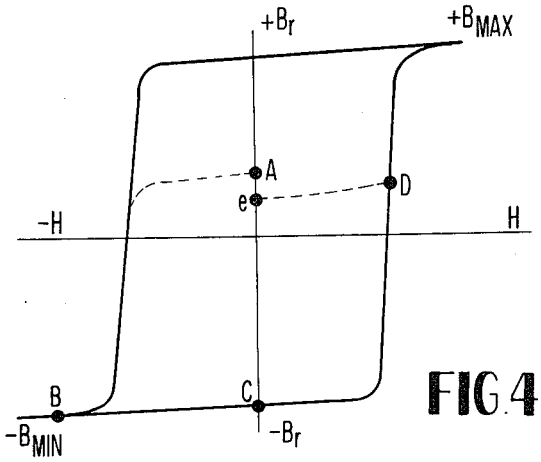
FIG. 4 is a diagram illustrative of the hysteresis loop for the phaser core shown in FIG. 3.

Because RF phase shift in a ferrite phaser is a function of the longitudinal magnetic flux in the core 28 which comprises a ferrite rod, the operation of the latching ferrite phase shifter depends on the hysteresis loop of the ferrite. The switching coil assembly 30 shown in FIG. 2 is comprised of two coils, a reset coil 44 and a set coil 46 connected in opposing polarities as shown in FIG. 3 and are adapted to be connected across and energized by a supply voltage V by means of suitable switching elements, for example, transistors 48 and 50 respectively coupling the ends of the coils opposite the supply voltage V to a point of reference potential shown as ground. The operation of the latching ferrite phaser depends upon the hysteresis loop characteristic of the ferrite core 28 which is shown in FIG. 4. The ferrite can latch in any partially magnetized state along the vertical $B_r$ axis between the negative remnant state $-B_r$ and the positive remnant state $+B_r$, giving it the desired phase shift without supplying continuous power to hold the flux setting.

To change the phase angle of a phaser, two methods are generally used, two cycle and three cycle switching. Because of the squareness of the hysteresis loop obtainable in ferrite material, the less complex two cycle method is most often used, however, the three cycle method may be utilized when desirable. For purposes of explanation, however, the two cycle switching will be described with respect to the subject invention. With reference to FIG. 4, assuming that the ferrite core 28 shown in FIG. 3 has been previously magnetized to point A by a previous phase setting and that no current is flowing in either of the coils 44 or 46, point A will produce a predetermined phase shift and it will remain as long as no current flows in either of the coils. To change the phase of the phaser the reset transistor 48 is first turned on, rendering it conductive, which applies the voltage V across the reset winding 44 until the flux reaches the negative saturation state $-B_{min}$ at point B. The transistor 48 is next turned off and in doing so, the flux in the core 28 falls back to the negative remnant state point C. Next the set transistor 50 is turned on, which causes the voltage V to be applied across the set winding 46 until the flux, for example, reaches point D, at which time the transistor 50 is turned off and the flux falls back to some intermediate remnant state at point E. The flux state at point E thus becomes another magnetized state producing a new predetermined phase shift which remains until the next phase changing sequence.

Thus a change in the flux along the $B_r$ axis represents a change in phaser phase shift. The reset cycle accordingly sets the flux in the negative remnant state which acts as a reference while the set cycle sets the flux by the turning on the set transistor 48 either for a fixed time or by integrating the voltage across the winding, the latter utilizing the well known technique of flux feedback.

With either a timed input or flux feedback, the flux depends on the following relationship:

$$V = N\,(d\phi/dt) \qquad (1)$$

or $$\Delta\phi = 1/N \int V dt \qquad (2)$$

where V is the effective voltage across the coil, N is the number of coil turns, $t$ represents time and $\phi$ is the magnetic flux. Where the saturation voltage of the driving transistors is small, the above relationship will hold for all practical considerations.

The timed input method accordingly depends on the voltage remaining constant during the time the transistor is on for the set cycle. If the power supply voltage V varies, non-negligible error results for the resulting phase shift. The flux feedback method integrates the voltage until the integral reaches a predetermined value set by the input. When the two are equal, the set transistor turns off, terminating the set cycle. The flux feedback method thus acts to compensate for a change in voltage and in some degree also compensates for temperature.

As noted above, where a large quantity of phasers which are arranged in rows and columns in a matrix array, it frequently becomes necessary to multiplex the data where for example a time shared data line is adapted to feed a common phase shift control signal to all of the phasers of a row, which data is stored until a common load command signal is applied to a column of phasers whereupon the data previously stored in each of the phasers of that column is transferred to the driver circuit, whereupon a reset and a set sequence take place. Again, as noted above, capacitor type storage of the phase data is undesirable.

Figure 5:
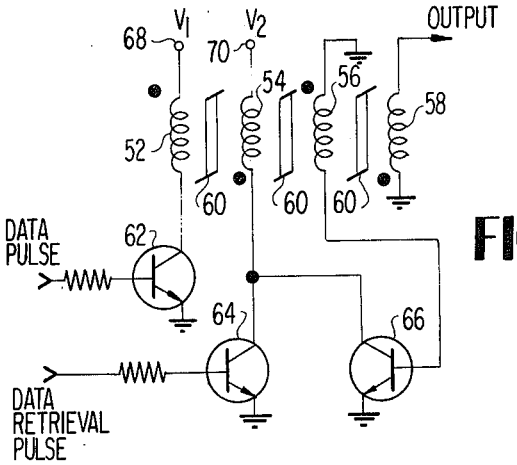
FIG. 5 is a schematic diagram illustrative of improved analog phase angle data storage circuit adapted for use in connection with the subject invention.

To this end an improvement in phase data storage and transfer is provided by the magnetic circuit configuration shown in FIG. 5. The circuit includes a data winding 52, a memory winding 54, a feedback winding 56, and an output winding 58, all wound on a common core 60 comprised of magnetic material marketed under the trade name "OPTHONAL" by Magnetics, Inc. of Butler, Pa. This material has a very high permeability and a substantially square hysteresis loop. A torroid made of this material and having no air gap provides excellent storage characteristics. The data winding 52 is adapted to be coupled to a data pulse source, not shown, by means of transistor 62. The memory winding 54 is coupled to a data retrieval pulse source, not shown, by means of transistor 64. The feedback winding 56 is coupled back to the memory winding 54 by means of a transistor 66.

In operation assume that the core 60 is magnetized at the reference point E (FIG. 6) which is the negative remnant state, and that the transistors 62, 64 and 66 are non-conductive. No power is drawn from the supply sources, not shown, providing the voltages $V_1$ and $V_2$ coupled to terminals 68 and 70. As soon as the transistor 62 receives a data pulse having a time duration of $\Delta t$, transistor 62 turns on and the voltage $V_1$ is applied across the data winding 52 for the time $\Delta t$. The flux moves along the hysteresis loop shown in FIG. 6 at point F, which is determined by:

$$\Delta\phi = \frac{1}{N_1} \int_0^{\Delta t} V_1\, dt \qquad (3)$$

where $N_1$ is the winding turns of the data winding 52. At the end of the data pulse time $\Delta t$, transistor 62 becomes non-conductive and the flux falls back to point G of FIG. 6 where a flux $\phi_1$ remains indefinitely, drawing no power from the supply potentials $V_1$ and $V_2$ until a time comes to retrieve the data. At such time, a pulse is applied to transistor 64 causing the voltage $V_2$ to be applied across the winding 54. Due to the relative polarity of windings 52 and 54, the field collapses, however, the feedback winding 56, due to its polarity connection, triggers transistor 66 on until the core 60 is driven to the negative saturation point H. If the voltages $V_1$ and $V_2$ are equal and there are an equal number of turns $N_1 = N_2$ in the data winding and memory winding 52 and 54, a pulse occurs across the output winding 58 which substantially reproduces the original pulse length $\Delta t$ previously applied. Transistors 62, 64 and 66 will again become non-conductive until the next data pulse is received, and the core goes back to point E, meanwhile, drawing no power from the supply sources. Thus when the data is read out by the application of the data retrieve pulse to transistor 64, the circuit automatically sets itself for the next data input, thus providing a one-shot circuit analogous to a one-shot multivibrator or blocking oscillator and thus may be considered broadly as a one-shot data transfer circuit.

When the transistor 62 of FIG. 5 receives the data pulse with a duration of $\Delta t = T_1$, the flux will move up the hysteresis loop to point G by:

$$\phi_1 = V_1/N_1 \cdot T_1 \quad (4)$$

When the data retrieval pulse is applied to transistor 64, however, the flux moves back to reference point E as follows:

$$\phi_2 = (V_2/N_2) \cdot T_2 \quad (5)$$

Figure 6:
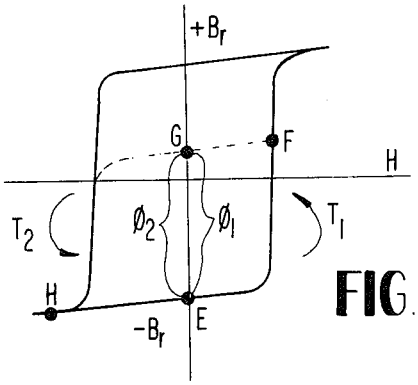
FIG. 6 is a diagram illustrative of the hysteresis loop for the core shown in FIG. 5.

However, as noted by FIG. 6, $\phi_1 = \phi_2$. Accordingly, $$V_1/N_1 \cdot T_1 = (V_2/N_2) \cdot T_2 \quad (6)$$

Rearranging terms, $$T_2 = T_1 \cdot (N_2/N_1) \cdot V_1/V_2 \quad (7)$$

Equation (7) indicates that by selectively choosing the turns ratio of the data ($N_1$) and memory ($N_2$) windings 52 and 54 and the power supply voltages $V_1$ and $V_2$, it is possible to compress the data input time $T_1$ when storing the data and later reproduce a longer pulse $T_2$, required to produce a desired phase shift, that is proportional to $T_1$.

Figure 7:
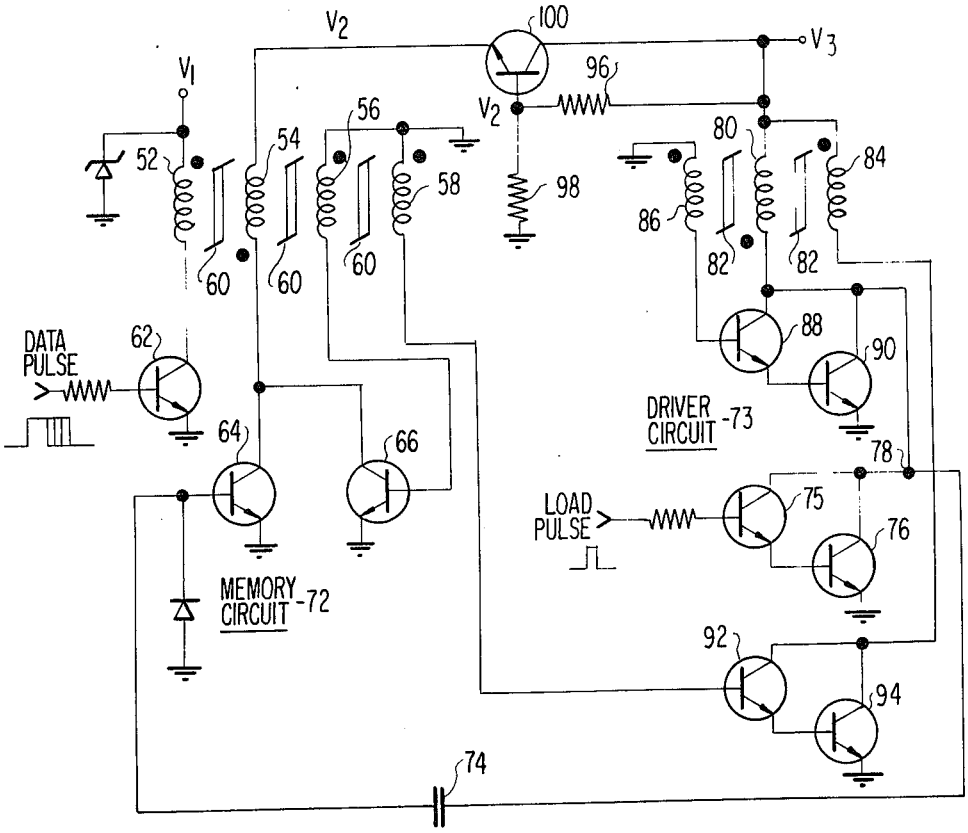
FIG. 7 is an electrical schematic diagram illustrative of a first embodiment of the subject invention.

Referring now to FIG. 7, there is disclosed a circuit which is adapted to utilize the teachings of FIG. 5 as well as the time compression feature expressed in equation (7). The circuit includes a memory circuit portion 72 which is substantially identical to FIG. 5 in that the four windings 52, 54, 56 and 58 are wound on a common core 60 together with the three transistors 62, 64 and 66 and a driver circuit portion 73. The data retrieve pulse is, however, now applied to transistor 64 via capacitor 74 from the common collector of transistors 75 and 76 which has a load pulse applied to the base of transistor 74. The common collector circuit junction 78 is also connected to one side of a reset winding 80 which is wound on a ferrite phaser core 82 together with a set winding 84 and a feedback winding 86 which is adapted to control the conduction of transistors 88 and 90, which when conductive couple the reset winding 80 across a supply potential $V_3$.

The output winding 58 of the memory circuit portion 72 is adapted to couple a phase control pulse to the set winding 84 of the driver circuit portion 73 through transistors 92 and 94 which act simply as a gate. The memory circuit portion 72 differs from that shown in FIG. 5 in the manner in which the voltage $V_2$ is coupled to the memory winding 54. In the circuit shown in FIG. 7, the supply potential $V_2$ is developed from the same supply potential $V_3$ feeding the reset and set windings 80 and 84. The supply voltage $V_2$ is provided by the voltage divider action of resistors 96 and 98 which is applied through transistor 100 to the memory winding 54.

Briefly, in operation data is received in the form of a pulsewidth modulated signal which is stored in the core 60 by means of transistor 62 and the data coil 52. The circuit remains inactive until a load command pulse initiates the reset cycle in the driver circuit portion 73 by grounding circuit junction 78. The reset winding 80, the feedback winding 86 and the two transistors 88 and 90 form a one-shot circuit, causing the core 82 to be driven hard into reset saturation (point B in FIG. 4) erasing any previous phase setting. Transistors 88 and 90 which have been driven on by the action of the feedback winding 86, turn off when the field collapses, causing a positive trigger to appear at circuit junction 78, which is coupled by means of capacitor 74 to transistor 64 and in effect comprises the data retrieval pulse required in FIG. 5. The one-shot action of the memory winding 54, the feedback winding 56, and the transistor 66 causes the output winding 58 to turn on transistors 92 and 94 and couple a new phase setting into the phaser core 82 by means of the set winding 84.

It should be pointed out that with respect to the circuitry shown in FIG. 7, the memory circuit 72 storing the data is of the same type that is using the data, i.e. the driver circuit 73, and they react in the same manner in that the one-shot operational mode is used in both circuit portions and additionally the part of the memory circuit that reproduces the data is fed from the same supply potential $V_3$ feeding the reset and set windings 80 and 84 providing a compensation for power supply variations. Thus if the voltage $V_3$ drops, the phaser core 82 requires a longer phase set period; however, the data repeater, i.e. the memory circuit winding 54, also gets a proportional decrease in supply voltage, making it generate a proportionately longer pulse in the output winding 58. In this way the circuit compensates for supply variations without a flux feedback circuit. The relationship between the data reproduce time $T_2$ and the phase set period $T_3$ is shown by the following equations:

$$T_2 = (N_2/V_2) \cdot \Delta\phi_2 \quad (8)$$

$$T_3 = (N_3/V_3) \cdot \Delta\phi_3 \quad (9)$$

where $N_2$ and $N_3$ are the number of turns on the memory winding 54 and the set winding 84, respectively. The number of turns $N_2$ and $N_3$ and the voltages $V_2$ and $V_3$ are selected to make $T_2$ and $T_3$ equal. Thus the voltage $V_2$ is related to $V_3$ by the following expression:

$$V_2 = (R_{96} + R_{98}/R_{96}) \cdot V_3 = k\, V_3 \quad (10)$$

As evidenced by equation (10), the voltage $V_2$ feeding the data reproducing portion of the memory circuit i.e. winding 54 is proportionately related to the voltage $V_3$ feeding windings 80 and 84 of the phaser driver circuit. If equations (8) and (9) are set equal whereupon $T_2 = T_3$, then the following expression results:

$$\Delta\phi_3 = (V_3/V_2) \cdot (N_2/N_3) \cdot \Delta\phi_2 \quad (11)$$

Noting that $k$ is equal to $V_2/V_3$, equation (11) can be restated as:

$$\Delta\phi_3 = (1/k) \cdot (N_2/N_3) \cdot \Delta\phi_2 \quad (12)$$

which relates the flux in the memory core 60 with the flux in the phaser core 82. It is also to be noted that the relationship as expressed in equation (12) is independent of the power supply variations.

The embodiment shown in FIG. 7 can be more generally depicted by the block diagram shown in FIG. 8 wherein reference numeral 72' denotes the memory circuit portion while reference numeral 73' designates the driver circuit portion. A memory core 60' has a data winding 52' and a memory winding 54' wound thereon. The phaser core 82' has a reset winding 80° and a set winding 84'. The data winding 52' is adapted to be driven by $V_1$ applied to terminal 102 in response to a pulsewidth modulated data pulse 104 applied to data line 106 via circuit means 108. The memory winding 54' is part of a one-shot circuit 110 which is adapted to include a data repeater circuit 112 which is coupled to the set winding 84' via suitable circuit means 114. The reset winding 80' forms part of a second one-shot circuit 116 which includes core erase circuit means 118. Where a load pulse 119 having a pulsewidth longer than the data pulse 104 is utilized, a differentiator circuit 120 can be utilized such that the leading edge of the pulse 119 is adapted to trigger the one-shot circuit 116 while the trailing edge is adapted to trigger the one-shot circuit 110. Also, as in the case of the embodiment shown in FIG. 1, the supply potential $V_2$ applied to the memory winding 54' is proportional to the supply voltage $V_3$ fed to the reset winding 80' and the set winding 82'. This is provided by circuit means 120 coupled from a common junction 121 of an energy storage capacitor 122 which is adapted to act as a filter and a current limiting resistor 124 coupled to a supply potential V applied to terminal 125.

Figure 9:
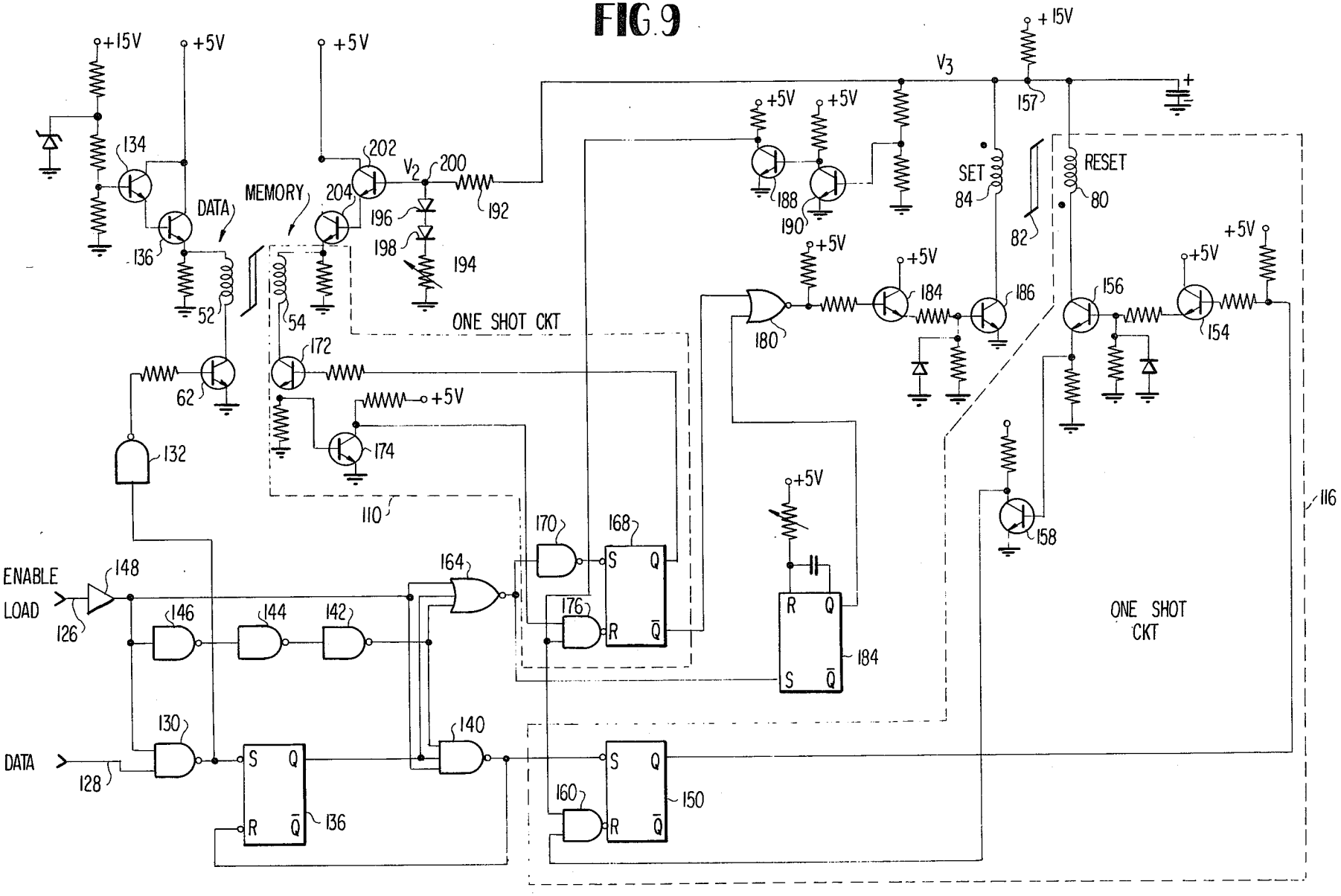
FIG. 9 is a schematic diagram illustrative of a second embodiment of the subject invention.
Figure 10:
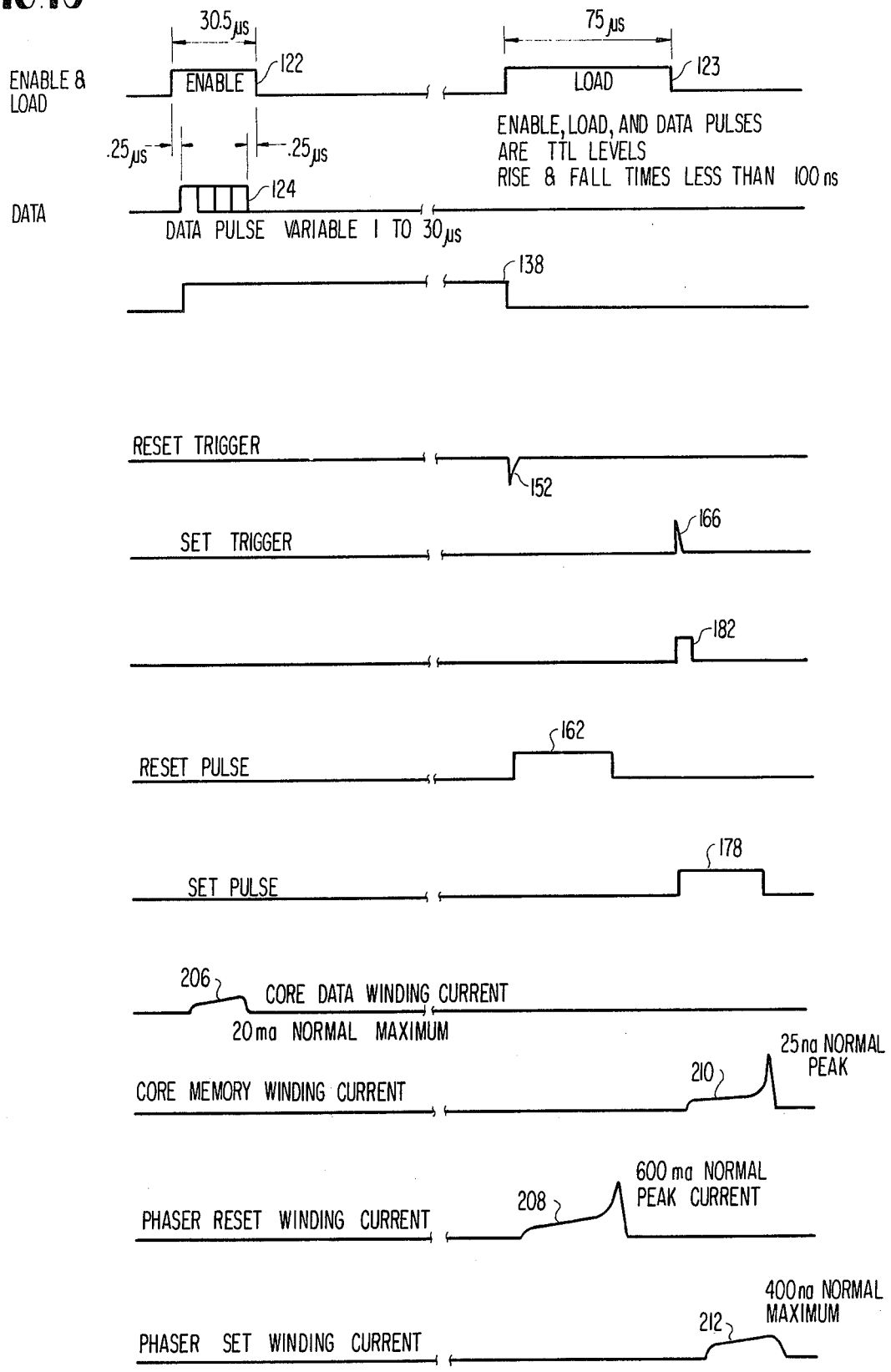
FIG. 10 is a time related diagram of selected signal waveforms illustrative of the operation of the embodiment shown in FIG. 9.

Turning attention now to FIG. 9, there is disclosed an embodiment of the subject invention employing more sophisticated gating techniques and utilizing semiconductor logic modules resulting from microcircuit fabrication. In the instant embodiment, an enabling signal is applied concurrently with the data signal as indicated by the pulse waveforms 122 and 124 shown in FIG. 10. The enable signal 122 is applied to the same signal line 126 as a subsequent load signal 123. The data pulse 124 is applied to a separate data line 128 as in the previous embodiment. With reference to FIG. 10, noting that the enable signal is coincident with and greater in pulse width than the maximum pulse width of the data pulse, they are applied to a NAND gate 130 whereupon the data pulse is coupled to NAND gate 132 and to the data winding transistor switch 62. A supply voltage $V_1 = +5V$ is adapted to be coupled across the data winding 52 through a pair of transistors 134 and 136 which is adapted to provide temperature compensation for the circuit inasmuch as the emitter base junction thereof exhibits, for example, a 6.5 microvolt per C° temperature variation in the proper sense to offset the temperature variation in the phaser core 82.

Upon the application of the data pulse to the NAND gate 130, a flip-flop circuit 136 is set and then reset upon the application of a subsequent load pulse as evidenced by pulse diagram 138 (FIG. 10). The combination of the NAND gate 140, 142, 144, 146 and the signal amplifier 148 provides a reset trigger to the set input of flip-flop 150, included in the one-shot circuit 116. The reset trigger is shown by pulse diagram 152 shown in FIG. 10. Upon the triggering of the flip-flop 150, transistors 154 and 156 are turned on by the Q output signal from flip-flop 150, whereupon voltage $V_3 \simeq 15V$ at junction 157 is impressed across the reset winding 80, causing it to be driven into its negative remnant state, at which time transistor 158 is rendered conductive, causing flip-flop 150 to be reset through NAND gate 160. The Q output of flip-flop 150 thus represents a reset pulse which is depicted by waveform 162.

The load pulse is also fed to a NOR gate 164 which acts in combination with NAND gates 142, 144 and 146 to provide a set trigger 166 (FIG. 10) which is applied to the one-shot circuit 110 and more particularly to the set input of flip-flop 168. The Q output of the flip-flop 168 is coupled to switch transistor 172 which is coupled to the memory winding 54. A switch transistor 174 is coupled back to the reset input of flip-flop 168 through NAND gate 176 in such a fashion that the Q output comprises the set pulse for the set winding 84 as depicted by waveform 178. The Q output of flip-flop 168 is applied to a NOR gate 180 which additionally has an enabling pulse 182 (FIG. 10) fed thereto provided by a one-shot multivibrator 184 which is triggered by the set trigger 166 appearing at the output of the NOR gate 164. The set pulse 178 is applied to the set winding through switch transistors 184 and 186.

The circuit shown in FIG. 9 also includes a pair of transistors 188 and 190 which are adapted to provide enabling inputs to the NAND gates 160 and 176 in response to the magnitude of the supply voltage $V_3$. As in the previous embodiment, a supply potential $V_2 = k V_3$ is applied to the supply side of the memory winding 54. This is provided by means of a resistive voltage divider comprised of resistors 192 and 194 together with the diodes 196 and 198. The voltage $V_2$ which appears at circuit junction 200 is applied to the winding 54 via transistors 202 and 204 which are also adapted to provide a temperature compensating action.

The current waveforms are additionally shown in FIG. 10. For example, waveform 206 is representative of the current in the data winding 52 in response to the data pulse 124. Upon the occurrence of the reset trigger 152 and the corresponding reset pulse 162, a current waveform 208 appears in the reset winding 80. The memory winding 54 exhibits a current characteristic such as waveform 210 upon the application of the reset trigger 166 which is transferred to the set winding 84 and having a current waveform 212 in time coincidence with current waveform 210.

The invention thus described provides an improved means for compensating for supply voltage variations while at the same time enabling time compression to be performed.

Having thus disclosed what is at present considered to be the preferred embodiments of the subject invention, I claim:

1. In a circuit for controlling a latching phaser in a phased array antenna system wherein the phaser includes a set and reset winding wound on a phaser core having a relatively high permeability and square type hysteresis loop, the improvement comprising, in combination:

a first and a second supply potential;

a memory core also having a relatively high permeability and square type hysteresis loop and including a pair of windings wound thereon, namely a data winding and a memory winding;

means coupling a data pulse signal of predetermined pulse width to said data winding causing said memory core to be coupled across said first supply potential and being energized thereby to cause said memory core to assume a predetermined flux remnant state;

first one-shot circuit means coupled to said reset winding, being responsive to a first control signal applied thereto to cause said reset winding to be coupled across said second supply potential and being energized thereby to cause said phaser core to be driven to a respective reference remnant state and thereby erase any previous remnant state;

second one-shot circuit means coupled to said memory winding being responsive to a second control signal applied thereto to cause said memory winding to be coupled across a third supply potential proportional to said second supply potential, said memory winding being energized by said third supply potential to cause said memory core to assume a respective reference remnant state and thereby generate a set signal in said memory winding having a pulse width proportional to said predetermined pulse width of said data signal;

circuit means coupling said set signal to said set winding causing said set winding to be coupled across said second supply potential and being energized thereby to cause said phaser core to assume a flux remnant state adapted to provide a selected phase shift for said phaser; and circuit means coupled to said second supply potential for providing said third supply potential, said third supply potential thereby being adapted to change in magnitude in response to any change in the magnitude of said second supply potential

2. The circuit as defined by claim 1 wherein said phaser core and said memory core are comprised of ferromagnetic material.

3. The circuit as defined by claim 1 wherein said memory core comprises a core of ferrite.

4. The circuit as defined by claim 1 wherein said magnitude of said third supply potential is proportionately less than the magnitude of said second supply potential.

5. The circuit as defined by claim 1 wherein said circuit means providing said third supply potential includes a voltage divider network wherein the magnitude of said third supply potential is less than the magnitude of said second supply potential.

6. The circuit as defined by claim 1 wherein said set signal has a pulse width $T_2$ related to the pulse width $T_1$ of the phase data signal by the following expression:

$$T_2 = T_1 \cdot N_2/N_1 \cdot V_1/V_2$$

where $N_1$ is the number of turns of said data winding and $N_2$ is the number of turns in said memory winding, $V_1$ is the magnitude of said first supply potential, and $V_2$ is the magnitude of said third supply potential.

7. The circuit as defined by claim 1 and additionally including memory core temperature compensating circuit means coupling said first supply potential to said data winding.

8. The circuit as defined by claim 7 wherein said temperature compensating circuit means comprises the base-emitter junction of at least one transistor.

9. The circuit as defined by claim 7 wherein said circuit means applying said third supply potential includes a voltage divider network and additionally including memory core temperature compensating means coupling said third supply potential to said memory winding.

10. The circuit as defined by claim 9 wherein said temperature compensating circuit means comprises the base-emitter junction of at least one transistor.

11. The circuit as defined by claim 1 wherein said second one-shot means includes a feedback winding wound on said memory core and switch means operably connected to said memory winding and being controlled by the operation of said feedback winding to cause the memory core to assume a flux saturation state.

12. The circuit as defined by claim 11 wherein said means coupling said set signal to said set winding includes an output winding wound on said memory core.

13. The circuit as defined by claim 1 wherein said first and second one-shot circuit means comprise a blocking oscillator circuit.

14. The circuit as defined by claim 1 wherein said first and second one-shot circuit means comprises triggered monostable multivibrator circuit means.

* * * * *

UNITED STATES PATENT AND TRADEMARK OFFICE

CERTIFICATE OF CORRECTION

PATENT NO. : 4,042,831

DATED : August 16, 1977

INVENTOR(S) : J. G. Lenhoff

It is certified that error appears in the above-identified patent and that said Letters Patent are hereby corrected as shown below:

Column 1, after the Title insert the following paragraph:

-- The invention herein described was made in the course of or under a contract or a subcontract with the Department of the Air Force. --.

Signed and Sealed this

*Twentieth* Day of *February 1979*

[SEAL]

*Attest:*

RUTH C. MASON
*Attesting Officer*

DONALD W. BANNER
*Commissioner of Patents and Trademarks*